US006758045B2

(12) United States Patent
Dimov et al.

(10) Patent No.: US 6,758,045 B2
(45) Date of Patent: Jul. 6, 2004

(54) METHODS AND APPARATUS FOR OPERATING GAS TURBINE ENGINES

(75) Inventors: Mina Dimov, Cincinnati, OH (US); Paul R. Angel, Fairfield, OH (US); Steven Marakovits, Mason, OH (US); Daniel Dale Brown, Fairfield, OH (US)

(73) Assignee: General Electric Company, Schenectady, NY (US)

( * ) Notice: Subject to any disclaimer, the term of this patent is extended or adjusted under 35 U.S.C. 154(b) by 87 days.

(21) Appl. No.: 10/233,356

(22) Filed: Aug. 30, 2002

(65) Prior Publication Data

US 2004/0040307 A1 Mar. 4, 2004

(51) Int. Cl.[7] ..... F02C 3/14
(52) U.S. Cl. ..... 60/804; 60/747; 60/772
(58) Field of Search ..... 60/804, 737, 747, 60/748, 752, 772

(56) References Cited

U.S. PATENT DOCUMENTS 3,764,071 A 10/1973 Carlisle
4,092,826 A 6/1978 Pask
4,222,243 A 9/1980 Mobsby
5,323,604 A * 6/1994 Ekstedt et al. ..... 60/804
5,630,319 A * 5/1997 Schilling et al. ..... 60/747
5,657,633 A * 8/1997 Brueggert ..... 60/747
5,675,971 A 10/1997 Angel et al.
5,680,766 A 10/1997 Joshi et al.
5,680,767 A * 10/1997 Lee et al. ..... 60/760
5,778,676 A 7/1998 Joshi et al.
5,899,075 A 5/1999 Dean et al.
6,141,967 A 11/2000 Angel et al.
6,415,594 B1 * 7/2002 Durbin et al. ..... 60/772

* cited by examiner

*Primary Examiner*—Charles G. Freay
(74) *Attorney, Agent, or Firm*—William Scott Andes; Armstrong Teasdale LLP; Robert B. Reeser, III

(57) ABSTRACT

A method enables a gas turbine engine multi-domed combustor including an outer liner and an inner liner that define a combustion chamber therebetween to be assembled. The method comprises coupling a first dome including a heat shield that includes an annular endbody that extends a first distance axially from the heat shield to the combustor outer liner, and coupling a second dome including a heat shield that includes an annular endbody that extends a second distance axially from the heat shield to the first dome, such that the second dome is radially aligned with respect to the first dome, and wherein the second dome second distance is less than the first dome first distance.

20 Claims, 3 Drawing Sheets

METHODS AND APPARATUS FOR OPERATING GAS TURBINE ENGINES

BACKGROUND OF THE INVENTION

This application relates generally to gas turbine engines and, more particularly, to combustors for gas turbine engines.

At least some known gas turbine engines include annular combustors which facilitate reducing nitrogen oxide emissions during gas turbine engine operation. Because of the heat generated within such combustors during operation, at least some known multiple annular combustors include a plurality of multiple dome assemblies that are radially aligned between the combustor dome plate and the combustion chamber. Each dome assembly includes a heat shield to protect the dome plate from excessive heat generated during engine operation.

At least some known dome assembly heat shields include annular endbodies that extend an axial distance downstream from the heat shield to separate the domes or stages of the combustor to enable primary dilution air to be directed into a pilot stage reaction zone, thus facilitating combustion stability of the pilot stage of combustion at various operating points. However, because the endbodies extend axially towards the combustion chamber, the endbodies are exposed to a high temperature and high acoustic energy environment. Over time, the combination of the high temperatures and high acoustic energy may induce thermal stresses, low cycle fatigue (LCF), and/or high cycle fatigue (HCF) into the heat shield assembly. Continued operation with such stresses may lead to cracking within the heat shield which may shorten the useful life of the combustor.

To facilitate reducing the effects of exposure to the high temperature and high acoustic energy environment, at least some known heat shield assemblies have employed various design changes to facilitate improving heat shield durability by addressing thermal and LCF failures. Such improvements have included for example, increased impingement cooling flow, surface film cooling, material changes, and/or heat shield contour changes to attempt to stiffen the component. However, such improvements did not completely address HCF failures caused by combustor acoustics. More specifically, due to engine-to-engine operating variation, and manufacturing/assembly tolerances, despite the improvements, at least some known heat shield natural frequencies remain within the combustor acoustic operating range, and over time, may still experience failures due to HCF fatigue.

BRIEF SUMMARY OF THE INVENTION

In one aspect, a method for assembling a gas turbine engine multi-domed combustor including an outer liner and an inner liner that define a combustion chamber therebetween is provided. The method comprises coupling a first dome including a heat shield that includes an annular endbody that extends a first distance axially from the heat shield to the combustor outer liner, and coupling a second dome including a heat shield that includes an annular endbody that extends a second distance axially from the heat shield to the first dome, such that the second dome is radially aligned with respect to the first dome, and wherein the second dome second distance is less than the first dome first distance.

In another aspect of the invention, an annular combustor for a gas turbine engine is provided. The combustor includes an outer liner, an inner liner, a first dome, and a second dome. The inner liner is spaced radially inwardly from the outer liner to define a combustion chamber therebetween. The first dome includes an outer end coupled to the outer liner and a heat shield including an annular endbody that extends outwardly a first distance axially from the heat shield towards the combustion chamber. The second dome is spaced radially inwardly from, and radially aligned with respect to the first dome. The second dome includes an outer end coupled to an inner end of the first dome, and a heat shield including at least one annular endbody that extends outwardly a second distance from the second dome heat shield. The second distance is less than the first dome first distance.

In a further aspect, a gas turbine engine including a combustor having a natural combustor acoustic operating range is provided. The combustor includes an outer liner, an inner liner, and a plurality of radially-aligned domes. The outer liner is coupled to the inner liner to define a combustion chamber therebetween. The plurality of domes include at least a first dome and a second dome. The first dome includes a heat shield including an annular endbody that extends a first axial distance from the first dome heat shield. The second dome is radially inward from the first dome and includes a heat shield including an annular endbody extending a second axial distance from the first dome heat shield. The second axial distance is less than the first dome first distance.

DETAILED DESCRIPTION OF THE INVENTION

Figure 1:
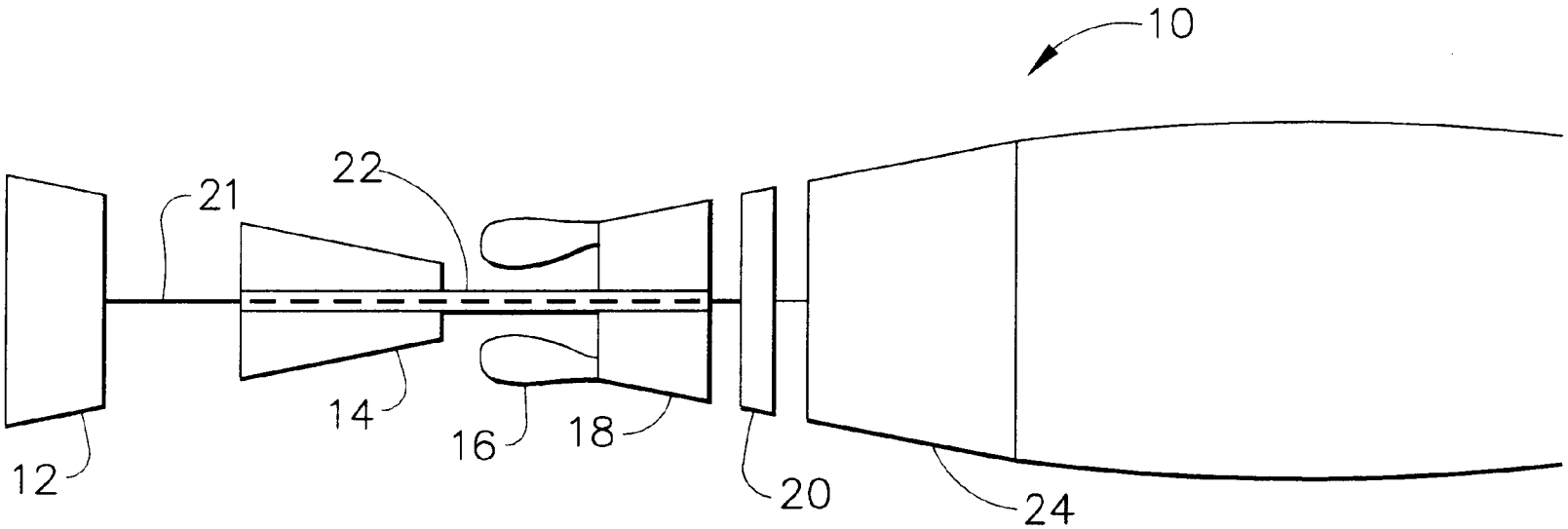
FIG. 1 is a schematic illustration of a gas turbine engine.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20. Combustor 16 is a lean premix combustor. Compressor 12 and turbine 20 are coupled by a first shaft 21, and compressor 14 and turbine 18 are coupled by a second shaft 22. A load (not shown) may also be coupled to gas turbine engine 10 with first shaft 21. In one embodiment, gas turbine engine 10 is an LM6000 available from General Electric Aircraft Engines, Cincinnati, Ohio.

In operation, air flows through low pressure compressor 12 and compressed air is supplied from low pressure compressor 12 to high pressure compressor 14. The highly compressed air is delivered to combustor 30. Airflow from combustor 16 drives turbines 18 and 20 and exits gas turbine engine 10 through a nozzle 24.

Figure 2:
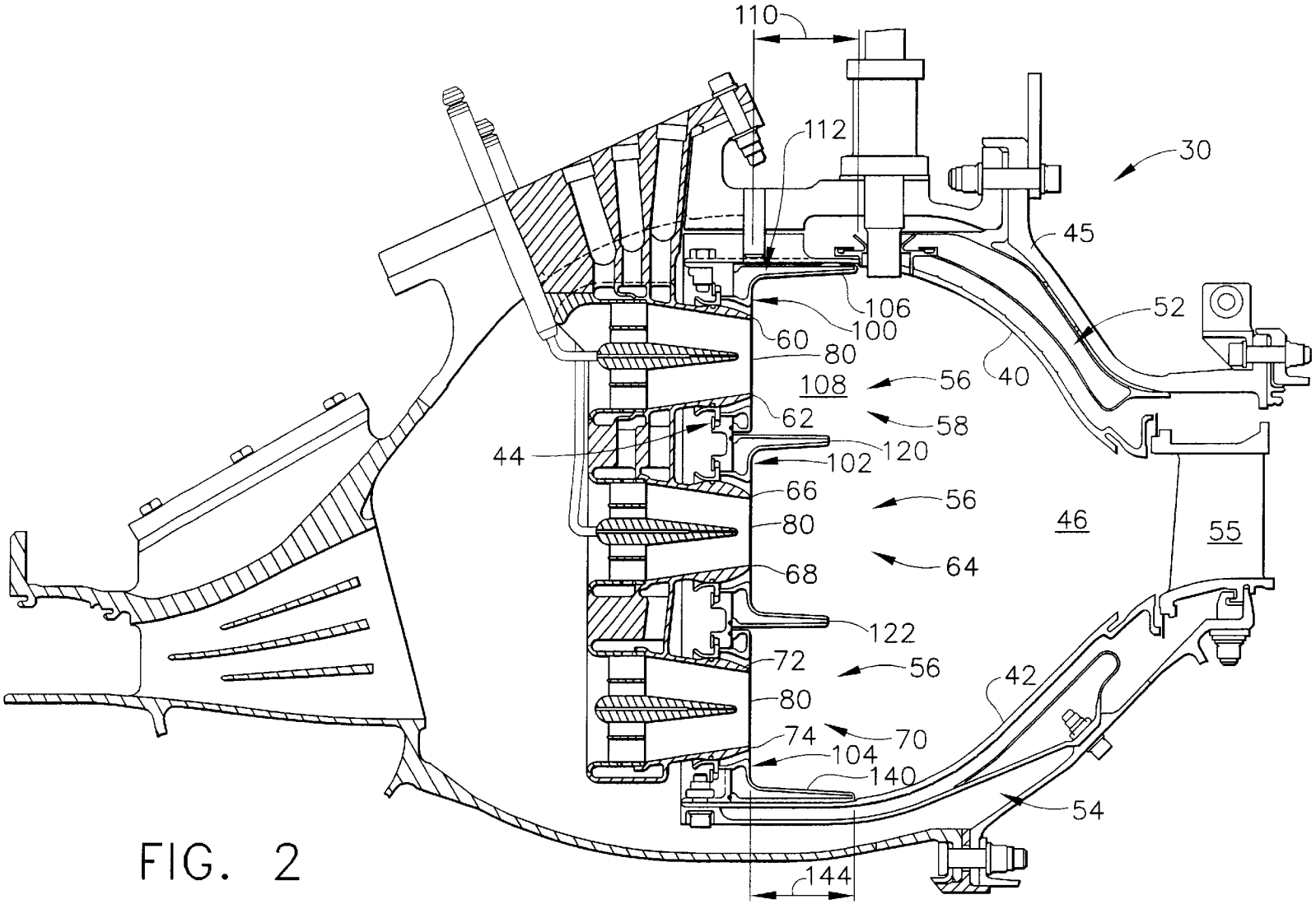
FIG. 2 is a cross-sectional view of a combustor that may be used with the gas turbine engine shown in FIG. 1.
Figure 3:
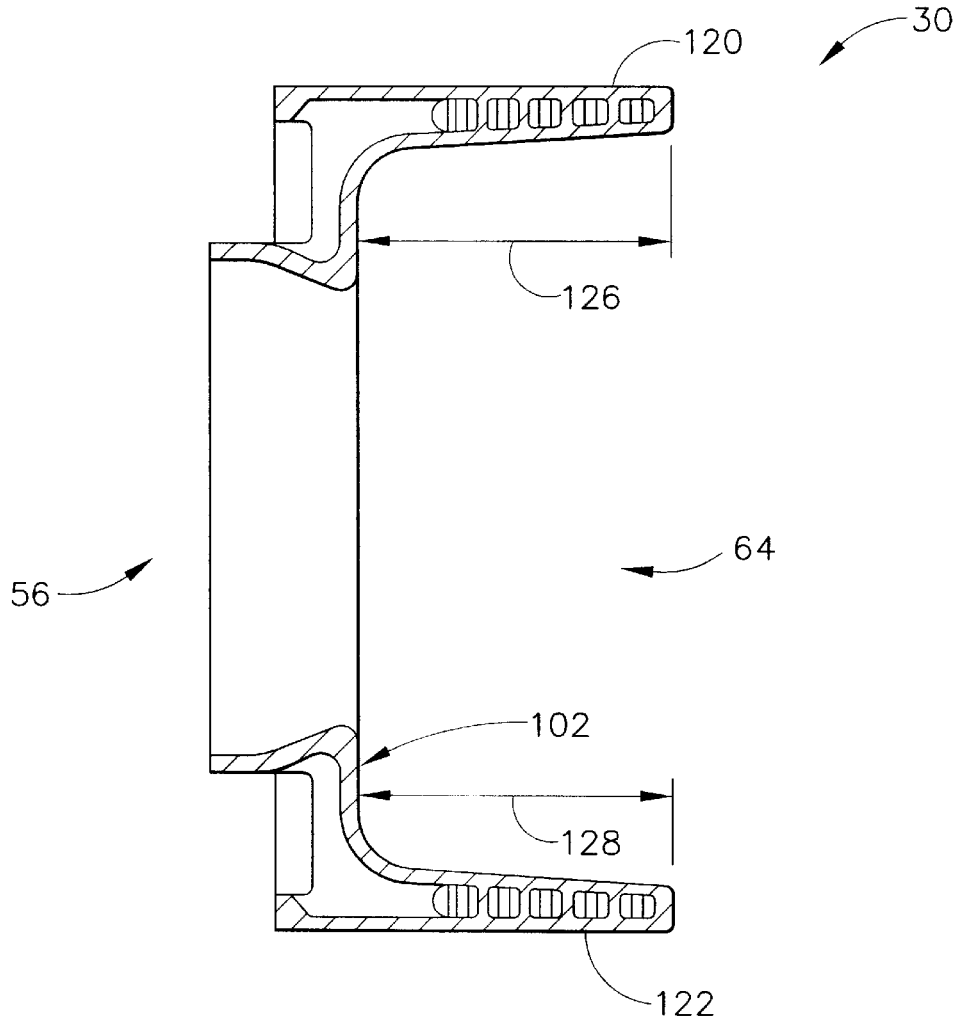
FIG. 3 is an enlarged cross-sectional view of a portion of the combustor shown in FIG. 2.

FIG. 2 is a cross-sectional view of a combustor 30 that may be used with gas turbine engine 10. FIG. 3 is an enlarged cross-sectional view of a portion of combustor 30. Because a fuel/air mixture supplied to combustor 30 contains more air than is required to fully combust the fuel, and because the air is mixed with the fuel prior to combustion, combustor 30 is a lean premix combustor. Accordingly, a fuel/air mixture equivalence ratio for combustor 30 is less than one. Furthermore, because a gas and a liquid fuel are supplied to combustor 30, and because combustor 30 does not include water injection, combustor 30 is a dual fuel dry low emissions combustor.

Combustor 30 includes an annular outer liner 40, an annular inner liner 42, and a domed end or dome plate 44 extending between outer and inner liners 40 and 42, respectively. Outer liner 40 and inner liner 42 are spaced radially inward from a combustor casing 45 and define a combustion chamber 46. Combustor casing 45 is generally annular and extends downstream from a diffuser 48. Combustion chamber 46 is generally annular in shape and is disposed radially inward from liners 40 and 42. Outer liner 40 and combustor casing 45 define an outer passageway 52 and inner liner 42 and combustor casing 45 define an inner passageway 54. Outer and inner liners 40 and 42 extend to a turbine nozzle 55 disposed downstream from diffuser 48.

Combustor domed end 44 includes a plurality of domes 56. In the exemplary embodiment, domes 56 are arranged in a triple annular configuration. Alternatively, combustor domed end 44 includes a double annular configuration. An outer dome 58 includes an outer end 60 fixedly attached to combustor outer liner 40 and an inner end 62 fixedly attached to a middle dome 64. Middle dome 64 includes an outer end 66 attached to outer dome inner end 62 and an inner end 68 attached to an inner dome 70. Accordingly, middle dome 64 is between outer and inner domes 58 and 70, respectively. Inner dome 70 includes an outer end 72 attached to middle dome inner end 68 and an inner end 74 fixedly attached to combustor inner liner 42.

Each dome 56 includes a plurality of premixer cups 80 to permit uniform mixing of fuel and air therein and to channel the fuel/air mixture into combustion chamber 46. In one embodiment, premixer cups 80 are available from Parker Hannifin, 6035 Parkland Blvd., Cleveland, Ohio. Combustor domed end 44 also includes an outer dome heat shield 100, a middle dome heat shield 102, and an inner dome heat shield 104 to insulate each respective dome 58, 64, and 70 from heat generated within combustion chamber 46. Heat shields 100, 102, and 104 are radially aligned within engine 10.

Outer dome heat shield 100 includes an annular endbody 106 to insulate combustor outer liner 40 from flames burning in an outer primary combustion zone 108. Endbody 106 extends outwardly an axial distance 110 from a downstream side 112 of heat shield 100 towards combustion chamber 46. Distance 110 is commonly known as a heat shield wing length. In one embodiment, distance 110 is approximately equal 1.95 inches. In the exemplary embodiment, endbody 106 extends substantially perpendicularly from heat shield 100.

Middle dome heat shield 102 includes annular heat shield centerbodies 120 and 122 to segregate middle dome 64 from outer and inner domes 58 and 70, respectively. Middle dome heat shield centerbodies 120 and 122 are positioned radially outwardly from a middle primary combustion zone 114, and each extends outwardly an axial distance 126 and 128, respectively, from a downstream side 130 of heat shield 102 towards combustion chamber 46. In the exemplary embodiment, endbodies 120 and 122 each extend substantially perpendicularly from heat shield 102, and as such are substantially parallel outer dome heat shield endbody 106.

Middle dome heat shield distance 126 is approximately equal distance 128. Endbody distances 126 and 128 are shorter than outer dome heat shield endbody length 110. More specifically, middle dome endbody distances 126 and 128 are at least 0.5 inches shorter than outer dome heat shield endbody length 110. In the exemplary embodiment, middle dome endbody distances are each equal approximately 1.25 inches.

Inner dome heat shield 104 includes an annular endbody 140 to insulate combustor inner liner 42 from flames burning in an inner primary combustion zone 142. Endbody 140 extends outwardly an axial distance 144 from a downstream side 146 of heat shield 100 towards combustion chamber 46. Endbody distance 144 is approximately equal outer dome heat shield distance 110. In one embodiment, endbody distance 144 is approximately equal 1.95 inches. In the exemplary embodiment, endbody 106 extends substantially perpendicularly from heat shield 100.

During operation of gas turbine engine 10, as combustor 30 uses radial fuel flow staging to facilitate reducing NOx and CO emissions over the engine operating range, combustor 30 has a natural acoustic operating range. Middle dome heat shield endbodies 120 and 122 facilitate providing additional structural support to middle dome 56. Specifically, because heat shield endbodies 120 and 122 have a shorted winglength 126 and 128 than outer dome and inner dome endbodies 106 and 140, respectively, middle dome endbodies 120 and 122 facilitate increasing a stiffness of middle dome heat shield 102 such that the natural frequency of middle dome heat shield 102 is increased above that of the combustor natural acoustic operating range, without adversely impacting engine operability. More specifically, the shortened winglength 126 and 128 does not adversely impact NOx and/or CO emissions, but does facilitate reducing vibrational stresses that may be induced to middle dome 56. As such, middle dome endbodies 120 and facilitate extending a useful life of combustor 30.

The above-described combustor system for a gas turbine engine is cost-effective and reliable. The combustor system includes a combustor including a heat shield that includes at least one endbody that has a shortend winglength in comparison to the other heatshield endbodies. The shortened winglength facilitates reducing vibrational stresses that may be induced to the dome assembly by increasing the natural frequency of the endbody above that of the combustor acoustic operating range, but without adversely affecting engine operability. As a result, the endbody facilitates extending a useful life of the combustor in cost effective and reliable manner.

Exemplary embodiments of combustor assemblies are described above in detail. The systems are not limited to the specific embodiments described herein, but rather, components of each assembly may be utilized independently and separately from other components described herein. Each combustor assembly component can also be used in combination with other combustor assembly components While the invention has been described in terms of various specific embodiments, those skilled in the art will recognize that the invention can be practiced with modification within the spirit and scope of the claims.

What is claimed is:

1. A method for assembling a gas turbine engine multi-domed combustor including an outer liner and an inner liner that define a combustion chamber therebetween, said method comprising:

coupling a first dome including a heat shield that includes an annular endbody that extends a first distance axially from the heat shield to the combustor outer liner; and coupling a second dome including a heat shield that includes an annular endbody that extends a second distance axially from the heat shield to the first dome, such that the second dome is radially aligned with respect to the first dome, and wherein the second dome second distance is less than the first dome first distance.

2. A method in accordance with claim 1 wherein coupling a second dome including a heat shield further comprises coupling a second dome including an annular endbody that extends outwardly a second distance from the heat shield, wherein the second distance is at least approximately 0.5 inches shorter than the first dome first distance.

3. A method in accordance with claim 1 wherein coupling a second dome including a heat shield further comprises coupling a second dome including an annular endbody that extends outwardly a second distance from the heat shield that is approximately equal 1.25 inches.

4. A method in accordance with claim 1 wherein coupling a second dome including a heat shield further comprises coupling a second dome including an annular endbody that extends outwardly a second distance from the heat shield, wherein the second distance is less than approximately 1.25 inches.

5. A method in accordance with claim 1 wherein coupling a second dome including a heat shield further comprises coupling a second dome including an annular endbody that extends outwardly a second distance from the heat shield to facilitate increasing a natural frequency of the annular endbody above a combustor natural acoustic operating range.

6. An annular combustor for a gas turbine engine, said combustor comprising:

an outer liner;

an inner liner spaced radially from said outer liner to define a combustion chamber therebetween;

a first dome comprising an outer end coupled to said outer liner and a heat shield comprising an annular endbody extending outwardly a first distance axially from said heat shield towards said combustion chamber; and a second dome spaced radially inwardly from, and radially aligned with respect to said first dome, said second dome comprising an outer end coupled to an inner end of said first dome, and a heat shield comprising at least one an annular endbody extending outwardly a second distance from said second dome heat shield, said second distance less than said first dome first distance.

7. A combustor in accordance with claim 6 wherein said second dome second distance is at least approximately 0.5 inches shorter than said first dome first distance.

8. A combustor in accordance with claim 6 wherein said second dome second distance is less than approximately 1.50 inches.

9. A combustor in accordance with claim 6 wherein said second dome second distance is approximately equal 1.25 inches.

10. A combustor in accordance with claim 6 further comprising a third dome spaced radially inwardly from said second dome, said third dome radially aligned with respect to said first and second domes, said third dome comprising an outer end coupled to an inner end of said second dome, and a heat shield comprising an endbody extending outwardly a third distance from said third heat shield, said second dome second distance less than said third dome third distance.

11. A combustor in accordance with claim 6 wherein said second dome further comprises a plurality of annular endbodies extending outwardly a second distance from said second dome heat shield.

12. A combustor in accordance with claim 6 wherein the combustor has a natural acoustic operating range, said second dome at least one annular endbody facilitates increasing a natural frequency of said at least one annular endbody above the combustor natural acoustic operating range.

13. A gas turbine engine comprising a combustor having a natural combustor acoustic operating range, said combustor comprising an outer liner, an inner liner, and a plurality of radially-aligned domes, said outer liner coupled to said inner liner to define a combustion chamber therebetween, said plurality of domes comprising at least a first dome and a second dome, said first dome comprising a heat shield comprising an annular endbody extending a first axial distance from said first dome heat shield, said second dome radially inward from said first dome and comprising a heat shield comprising an annular endbody extending a second axial distance from said first dome heat shield, said second axial distance less than said first dome first distance.

14. A gas turbine engine in accordance with claim 13 wherein said combustor second dome second distance configured to facilitate increasing a natural frequency of said second dome endbody above the combustor natural acoustic operating range.

15. A gas turbine engine in accordance with claim 14 wherein said combustor second dome second distance is at least approximately 0.5 inches shorter than said first dome first distance.

16. A gas turbine engine in accordance with claim 14 wherein said combustor second dome second distance is less than approximately 1.50 inches.

17. A gas turbine engine in accordance with claim 14 wherein said combustor second dome second distance is approximately equal 1.25 inches.

18. A gas turbine engine in accordance with claim 14 wherein said combustor second dome further comprises a plurality of annular endbodies extending outwardly a second distance from said second dome heat shield.

19. A gas turbine engine in accordance with claim 14 wherein said combustor further comprises a third dome spaced radially inwardly from said second dome, said third dome comprising an endbody extending outwardly a third distance from said third heat shield, said third distance approximately equal said first dome first distance.

20. A gas turbine engine in accordance with claim 14 wherein said combustor second dome endbody configured to facilitate extending a useful life of said combustor.

* * * * *